United States Patent [19]

Martin et al.

[11] 4,087,024

[45] May 2, 1978

[54] FLUID DISPENSER

[75] Inventors: Harold B. Martin, West Caldwell; Arthur R. Weber, Somerset, both of N.J.

[73] Assignee: Graber-Rogg, Inc., Cranford, N.J.

[21] Appl. No.: 662,245

[22] Filed: Feb. 27, 1976

[51] Int. Cl.[2] ..... B65D 37/00

[52] U.S. Cl. ..... 222/211

[58] Field of Search ..... 222/92, 107, 481.5, 222/561, 188, 479, 481, 494, 211–213

[56] References Cited

U.S. PATENT DOCUMENTS

| | | | |
|---|---|---|---|
| 2,014,881 | 9/1935 | Carlstrom | 222/481 X |
| 2,250,022 | 7/1941 | Hoffman | 222/92 |
| 2,532,690 | 12/1950 | Zimmerman | 222/92 |
| 2,642,204 | 6/1953 | Dixon | 222/92 |
| 2,784,882 | 3/1957 | DuBois | 222/211 X |
| 2,854,175 | 9/1958 | Spitzmesser | 222/211 X |
| 3,176,883 | 4/1965 | Davis, Jr. | 222/211 X |
| 3,372,846 | 3/1968 | Berkus | 222/479 |

*Primary Examiner*—Joseph F. Peters, Jr.
*Assistant Examiner*—Norman L. Stack, Jr.
*Attorney, Agent, or Firm*—John J. Lipari

[57] ABSTRACT

A fluid dispenser which includes a container having a collapsible, recoverable portion and a valve assembly connected thereto which includes a flexing flap for closing and opening an air opening extending into the container for permitting air to enter the container, the air being compressed and used to dispense fluid from the container through a valve nozzle in response to the actuation of the collapsible, recoverable portion.

2 Claims, 2 Drawing Figures

FLUID DISPENSER

BACKGROUND OF THE INVENTION

This invention relates to fluid dispensers and, in particular, to a collapsible, recoverable type fluid dispenser, incorporating a separate or replenishment system.

Heretofore, dispensers utilized to dispense fluids included the squeeze bottle type or those employing aerosol propellants or mechanical pumps for causing the work fluid to be dispensed from the container. In view of the public concern regarding the use of aerosol propellants, such a carbon dioxide or fluoro-carbons, e.g. freon, which when released into the atmosphere can actually cuase a reduction of the ozone layer surrounding the earth and thereby relatively increase the occurence of skin cancer, the use of such aerosol containers are undesirable. On the other hand, those containers employing mechanical pumps generally involve either complex components or mechanisms which "leak" or both. Further, the use of squeeze bottle mandate a pick-up and tilt of the bottle to initiate a dispensing of the fluid, when the bottles are less than full.

SUMMARY

Accordingly, it is an object of this invention to provide a new and improved dispenser which is provided with a collapsible, recoverable portion and a valve assembly connected to the container for emitting fluid from the container through a nozzle associated with said valve assembly.

It is another object of this invention to provide in a collapsible, recoverable type fluid dispenser, a new and improved valve for permitting air to enter through the valve and into the container, said air then being compressed for discharging the work fluid from the chamber of the container and through the valve nozzle.

Broadly, the invention relates to a fluid dispenser which includes a container having a collapsible, recoverable portion which is capable of compressing air, and a valve assembly connected to the container. Means are cooperatively associated with the valve assembly for dispensing a liquid therethrough in response to the actuation of the collapsible, recoverable portion of the container.

More specifically, the valve assembly includes an air opening, a dispensing nozzle and a dispensing tube extending into the container. A flexing flap is normally located in intimate contact with air opening, and is urged against the opening when the container is compressed and caused to open when the actuating force on the container is removed. Compression of the container causes the fluid to be dispensed and, as the container recovers to its resting position, air is replaced within the container via said opening.

DRAWINGS

Other objects and a fuller understanding of the invention may be had by referring to the drawing wherein:

FIG. 1 is a partial elevational and cross-sectional view of the container and a cross-sectional view of the valve assembly; and, FIG. 2 is a partial explosive view depicting the valve's lower member with flexing flap and the upper member.

DESCRIPTION OF THE PREFERRED EMBODIMENT

Figure 1:
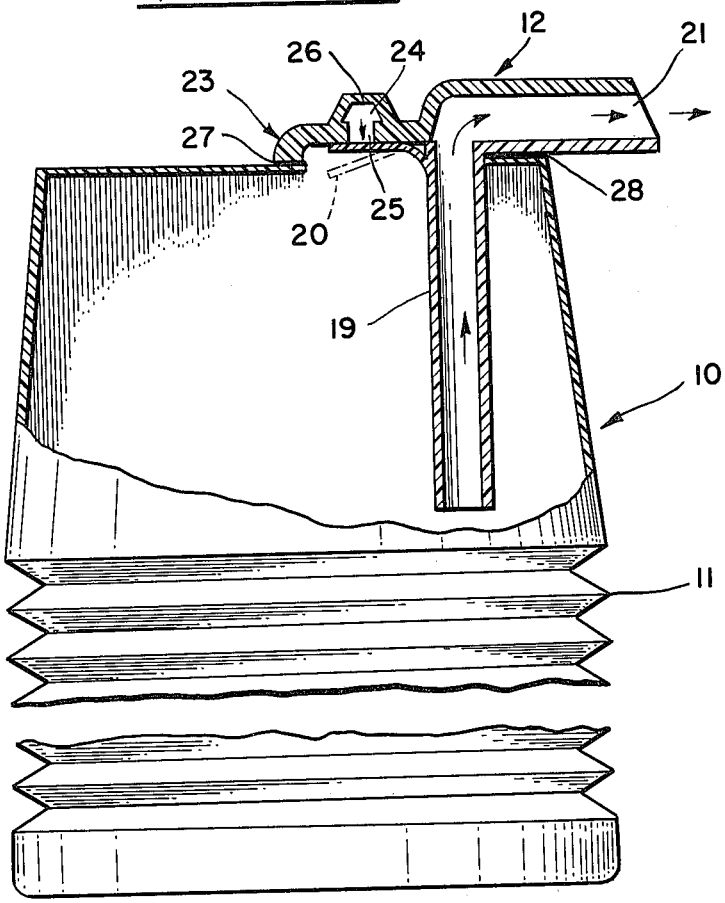

With reference to the drawing, there is depicted a container, generally referred to at 10, which includes a bellowed wall portion 11, said container being made of a suitable material, such as ethly vinyl acetate for permitting a compression and expansion of the bellow portion, as described hereinafter.

Figure 2:
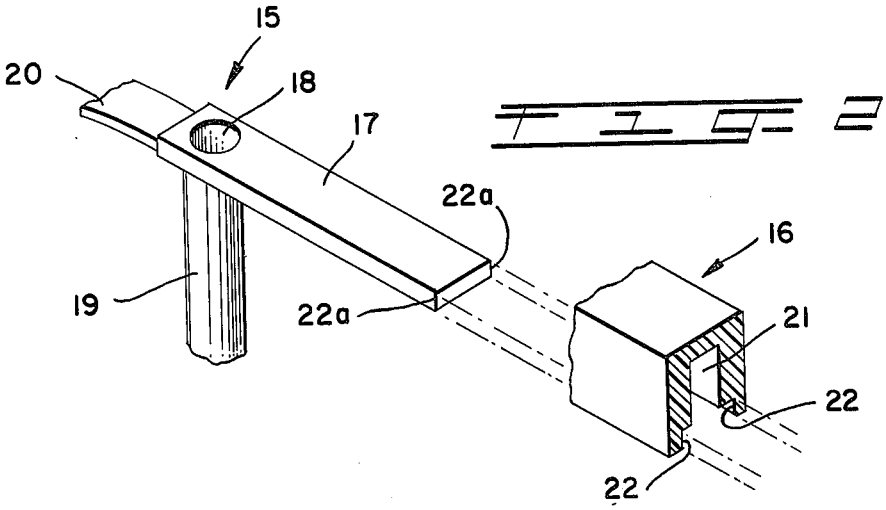

Located at the top of the container is a valve assembly, generally referred to at 12, which is made of a plastic material, such as polystyrene and, as seen in FIG. 2 is comprised of a molded lower member 15 and a molded upper member 16. The lower member includes a base 17 having an opening 18 therein which communicates with a dispensing tube 19 extending downwardly therefrom and into the container. Located at one end of the base is a flexing flap or membrane 20 which normally extends in a raised position therefrom.

Upper member 16 includes an inverted, substantially U-shaped nozzle 21 having recessed ways 22—22 which locate the lateral surfaces *22a—22a* of base 17 connecting lower member 15 to upper member 16. Preferably, a sealant is located on ways 22—22 and *22a—22a* for positively holding the lower and upper members together. Integrally extending from nozzle 21 is a head portion 23 which is provided with a laterally extending passage 24 having an air opening 25 which communicates with the container chamber said air opening on membrane 20 functioning as a valve responsive to the actuation of the bellowed wall portion 11. A protective guard 26 extends over air opening 24 for not only precluding any dirt or debris from entering the air opening but also for preventing any user from inserting any unwanted foreign object through said opening so as to depress flap 20, located therebeneath and in a normally closed position therewith, to remove any dispensing material or work fluid from the container.

The upper and lower members are assembled such that nozzle 21 substantially covers all of base 17 and base opening 18, while the air openings 25 of head portion 23 is positioned over flap 20, the latter being normally positioned in intimate contact therewith. Valve assembly 12 is connected to container 10 by a suitable sealant, at 27 and 28 respectively.

In operation, a manually external force is placed on the container 10 which causes the collapsible recoverable portion 11 to be compressed. This results in an increase in internal air pressure which urges the flap 20 firmly against the air opening 25 to cause the fluid to be displaced up the dispensing tube 19 and out the nozzle 21 as collapsing continues. When the actuating force on the container is removed, the recoverable tendency generates an internal negative pressure, (a vacuum), which causes flap 20 to be lifted off the air opening 25, so that air enters from the atmosphere, replacing the dispensed fluid and allowing the container to return to its normal resting position, ready for another dispensing cycle.

While a container with a bellowed wall portion has been described in the preferred embodiment, it is understood that any collapsible, recoverable container, other than a bellowed wall portion, can be utilized in combination with the valve of this invention.

We claim:

1. In a fluid dispenser having a container provided with a bellowed wall portion to form a chamber, and which is capable of compressing and recovering in response to the application of a force thereon, a molded valve assembly connected to said container, which comprises:

a lower member having a base provided with an aperture therein, a dispensing tube communicating with said aperture, a flex type flap member integrally connected to and extending from said base in a substantially similar plane, said flap member having a thickness relatively smaller than that of the base, and an upper member having a body portion removably connected to said base and which forms a dispensing nozzle when connected to said base, a head portion extending from said body portion, and a formed air opening extending through said head portion for communication with the chamber of the container, said air opening being located in spacial relationship with the container chamber such that one side of the flex type flap member is in normally intimate contact with the formed air opening and the other side of the flap member is exposed to the container chamber, the member capable of being moved from said air opening in response to external air passing through said air opening into the container and being moved against said air opening upon compressed air being generated within the container for forcing fluid from the chamber through the dispensing tube and dispensing nozzle.

2. In a fluid dispenser, according to claim 1, wherein the lower member and upper member are comprised of a molded material.

* * * * *